US006101356A

United States Patent [19]

Kim et al.

[11] Patent Number: 6,101,356

[45] Date of Patent: Aug. 8, 2000

[54] CARRIER RECOVERY APPARATUS OF LIQUID ELECTROPHOTOGRAPHIC PRINTER

[75] Inventors: Jong-woo Kim, Yongin; Un-ho Baik, Suwon, both of Rep. of Korea

[73] Assignee: Samsung Electronics Co., Ltd., Kyungki-do, Rep. of Korea

[21] Appl. No.: 09/347,228

[22] Filed: Jul. 2, 1999

[30] Foreign Application Priority Data

| | | | |
|---|---|---|---|
| Jul. 3, 1998 | [KR] | Rep. of Korea | 98-26826 |
| Dec. 11, 1998 | [KR] | Rep. of Korea | 98-54530 |
| Dec. 18, 1998 | [KR] | Rep. of Korea | 98-56196 |

[51] Int. Cl.[7] ..... G03G 15/10

[52] U.S. Cl. ..... 399/250; 347/89; 347/93; 399/237

[58] Field of Search ..... 399/250, 251, 399/237, 57; 430/117; 324/71.1; 210/739, 744, 746, 767; 406/10, 19, 23; 347/7, 89, 93

[56] References Cited

U.S. PATENT DOCUMENTS

| | | | |
|---|---|---|---|
| 5,884,128 | 3/1999 | Park | 399/250 |
| 5,905,928 | 5/1999 | Shin | 399/250 |
| 5,933,689 | 8/1999 | Kim | 399/237 X |
| 5,950,054 | 9/1999 | Kim | 399/237 |
| 6,011,943 | 1/2000 | Kim | 399/237 X |

*Primary Examiner*—Sophia S. Chen

[57] ABSTRACT

The carrier recovery apparatus includes a water/carrier separating unit with a level sensor installed at a predetermined level on a purge tank. The level sensor detects the level of the liquid carrier in the purge tank and generates a signal representing the level of the liquid carrier. The water/carrier separating unit also has a pump driven to draw out the water and liquid carrier stored in the purge tank through a connection pipe connected to the bottom of the purge tank in accordance with the signal generated from the level sensor, a first branching pipe branched off from the connection pipe to be connected to a waste water tank, and having a first valve selectively opened or closed, a second branching pipe branched off from the connection pipe to be connected to the carrier tank, and having a second valve selectively opened or closed, and a conductivity sensor installed at one end of the first branching pipe, for detecting the conductivities of the water and the liquid carrier and transmitting a control signal for selectively opening or closing the first valve and the second valve.

11 Claims, 6 Drawing Sheets

CARRIER RECOVERY APPARATUS OF LIQUID ELECTROPHOTOGRAPHIC PRINTER

BACKGROUND OF THE INVENTION

1. Field of the Invention

The present invention relates to a liquid electrophotographic printer, and more particularly, to an apparatus for recovering only the liquid carrier from a developer liquid in which toner particles are mixed with a liquid carrier by separating out moisture unavoidably fed during circulation of the developer liquid.

2. Description of the Related Art

A liquid electrophotographic printer such as a laser color printer includes a development unit 20 for supplying a developer liquid in which a toner powder is mixed with liquid carrier to a photoreceptor belt 10 as a photosensitive medium, and developing an image, a drying unit 30 for absorbing and evaporating the liquid carrier remaining after being adhered to and used in development of an electrostatic latent image formed on the photoreceptor belt 10, and a printing unit 40 for printing the image developed on the photoreceptor belt 10 onto a sheet of paper 1.

The drying unit 30 includes a drying roller 31 for drying the residual liquid carrier of the developer liquid supplied to the photoreceptor belt 10 to absorb the same, a heating roller 32 for heating the drying roller 31 to evaporate the absorbed liquid carrier, and a manifold 33 installed to enclose the drying roller 31 and the heating roller 32 so as to be blocked from the outside.

The liquid carrier absorbed into the drying roller 31 is evaporated by the heating roller 32 and then condensed by a condenser 50 to be stored in a purge tank 60 in a liquefied state.

The liquid carrier stored in the purge tank 60 is mixed with a concentrated ink supplied from an ink cartridge (not shown) in a predetermined mixture ratio and is supplied to the development unit 20 for being recycled as a developer liquid.

However, since it is difficult for the manifold 33 to enclose the drying roller 31 and the heating roller 32 to be completely blocked from the outside, air is inevitably induced from the outside.

Since the air induced from the outside contains moisture, the moisture is induced into the condenser 50 together with the gas carrier evaporated by the heating roller 32 to then be recovered and stored in the purge tank 60 in a condensed state into water droplets and liquid carrier.

Thus, if the liquid carrier recovered and stored in the purge tank 60 is mixed with a concentrated ink supplied from the ink cartridge to be used as the solvent of the toner particles, the developer liquid cannot be maintained in a desired concentration due to the induced water droplets, which makes development defective, lowering the print quality. In a liquid electrophotographic printer, it is an absolute requirement to separate moisture from the condensed and restored liquid carrier in order to attain a high quality print image.

SUMMARY OF THE INVENTION

It is an objective of the present invention to provide a carrier recovery apparatus of a liquid electrophotographic printer, for recovering a carrier liquid to be recycled as a developer liquid, by accurately and effectively separating water that is unavoidably induced when liquid carrier remaining on a photoreceptor belt after being used in development, is condensed and recovered, and by mixing the liquid carrier with a concentrated ink.

Accordingly, to achieve the above objective, there is provided a carrier recovery apparatus for a liquid electrophotographic printer including a drying unit for absorbing liquid carrier from a developer liquid supplied to and remaining on a photoreceptor belt and evaporating the absorbed liquid carrier, a condenser for condensing the carrier gas evaporated by the drying unit and moisture from air induced from the outside into liquid carrier and water, respectively, a purge tank for storing water and liquid carrier condensed by the condenser, a carrier tank for sequentially storing the water and liquid carrier condensed by the condenser in a phase-separated state and storing a new liquid carrier additionally induced from the outside, water/carrier separating means for separating liquid carrier and water stored in the carrier tank from each other and making the same flow to different paths, respectively, a waste water tank for receiving from the carrier tank the water phase-separated from the liquid carrier by the water/carrier separating means, and storing the same, and a working solution tank for receiving from the carrier tank the liquid carrier phase-separated from the water by the water/carrier separating means, and mixing the received liquid carrier with concentrated ink supplied from an external ink storage tank, to produce a developer liquid.

The water/carrier separating means is constructed such that the bottom surface of the carrier tank slopes downward at one side, and includes a water sensor installed on the side wall of the carrier tank, an exhaust pipe which connects the carrier tank and the waste water tank for form a flow path, and a valve installed in the exhaust pipe to be selectively opened/closed depending on the presence of water detected by the water sensor.

The water sensor is preferably a conductivity sensor for detecting the conductivity of a predetermined liquid and generating a signal representing the presence of the liquid.

Also, according to another aspect of the present invention, there is provided a carrier recovery apparatus for a liquid electrophotographic printer including a drying unit for absorbing liquid carrier from a developer liquid supplied to and remaining on a photoreceptor belt and evaporating the absorbed liquid carrier, a condenser for condensing the carrier evaporated by the drying unit into liquid carrier, and condensing moisture from air unavoidably induced from the outside into water, a purge tank for storing the water and liquid carrier condensed by the condenser in a phase-separated state, water/carrier separating means for separating the liquid carrier and water stored in the purge tank from each other and making the same flow to different paths, respectively, a waste water tank for receiving from the purge tank the water phase-separated from the liquid carrier by the water/carrier separating means, and storing the same, and a carrier tank for receiving the carrier phase-separated from the water by the water/carrier separating means and storing the same, and additionally receiving a new carrier from the outside and storing the same.

The water/carrier separating means includes a water sensor installed at a predetermined level on the purge tank, for detecting the presence of water according to the change in the level of water, a first connection pipe connected to the bottom of the purge tank to form a path for connecting the purge tank and the waste water tank, a first valve installed in the first connection pipe to be selectively opened/closed depending on the presence of water detected by the water sensor and making the water flow from the purge tank to the waste water tank, a second connection pipe disposed directly above the water sensor to form a path for connecting the purge tank and the carrier tank, in one side of the purge tank.

Alternatively, a level sensor is preferably installed at a level position of the purge tank corresponding to the level of the liquid carrier collected on the water when the water level reaches the level position at which the water sensor is installed, and the second connection pipe preferably includes a pump selectively driven in accordance with presence of water detected by the water sensor, for drawing out the liquid carrier, and a second valve installed to be selectively opened/closed in accordance with the driving of the pump, for making the liquid carrier flow to the carrier tank.

According to still another aspect of the present invention, the water/carrier separating means includes a level sensor installed at a predetermined level on the purge tank, for detecting the level of the liquid carrier in the purge tank and generating a signal representing the level of the liquid carrier, a pump driven to draw out the water and liquid carrier stored in the purge tank through a connection pipe connected to the bottom of the purge tank in accordance with the signal generated from the level sensor, a first branching pipe branched off from the connection pipe to be connected to the waste water tank, and having a first valve selectively opened or closed, a second branching pipe branched off from the connection pipe to be connected to the carrier tank, and having a second valve selectively opened or closed, and a conductivity sensor installed at one end of the first branching pipe, for detecting the conductivities of the water and the liquid carrier and transmitting a control signal for selectively opening or closing the first valve and the second valve.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

Figure 2:
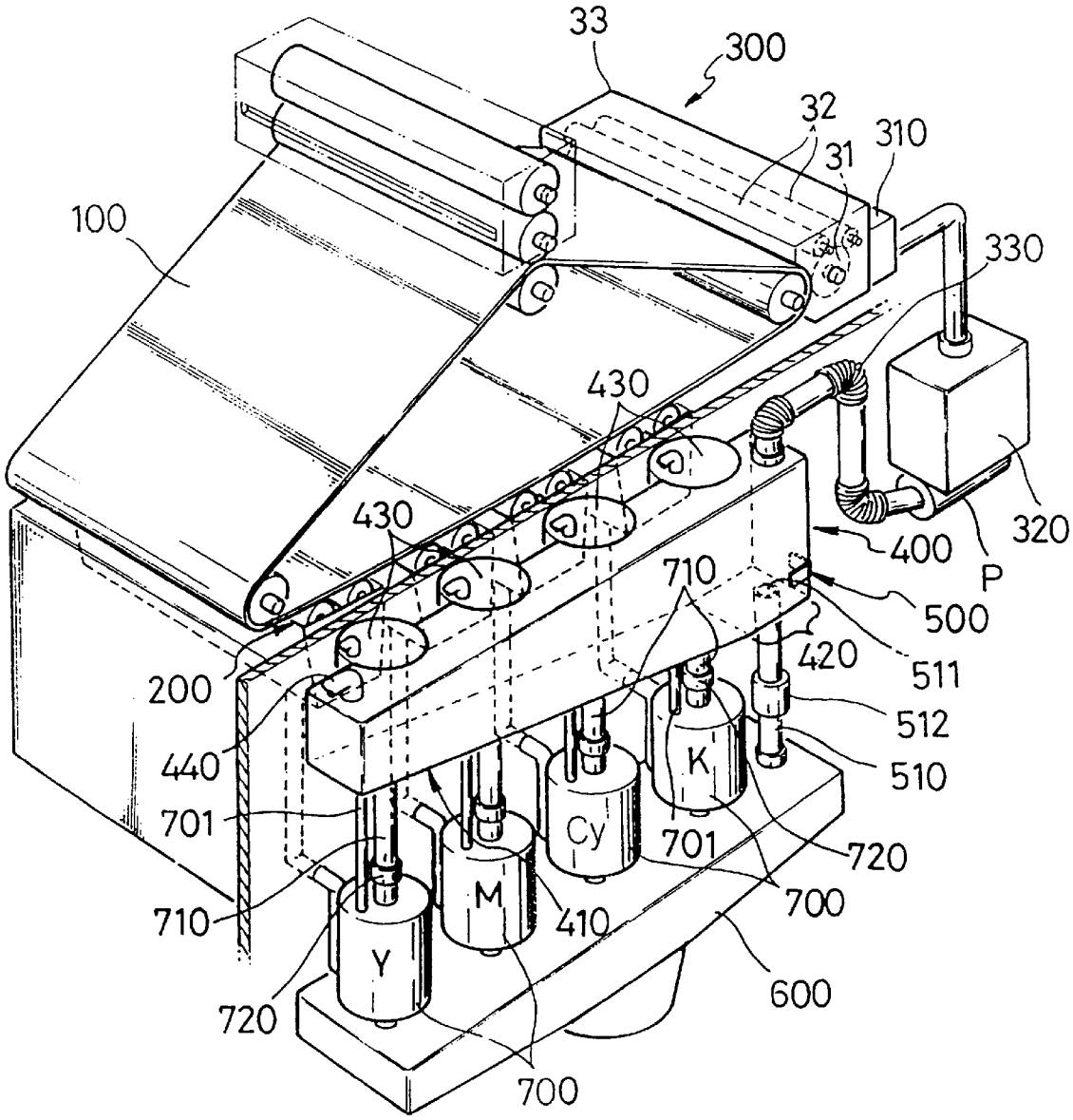
FIG. 2 is a schematic perspective view illustrating an essential portion of a carrier recovery apparatus according to an embodiment of the present invention.
Figure 3:
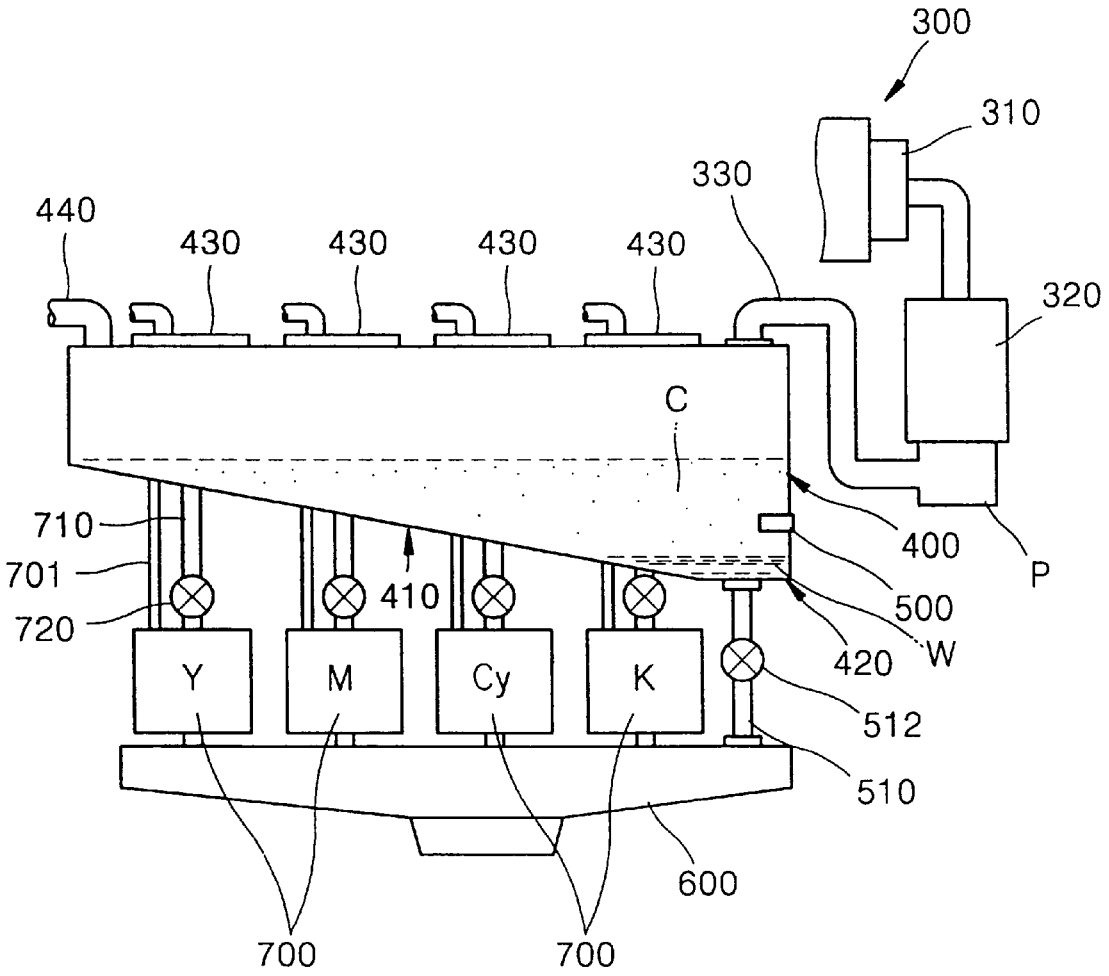
FIG. 3 is a schematic side view of a carrier recovery apparatus for a liquid electrophotographic printer shown in FIG. 2.

Referring to FIGS. 2 and 3, a carrier recovery apparatus for a liquid electrophotographic printer according to the present invention includes a drying unit 300, a condenser 310, a purge tank 320, a carrier tank 400, water/carrier separating means, a working solution tank 700 and a waste water tank 600. The drying unit 300 absorbs liquid carrier remaining after being adhered to and used in development of an electrostatic latent image formed on the photoreceotor belt 100, and evaporates the same. The condenser 310 condenses the carrier evaporated by the drying unit 300 into liquid carrier, and condenses the moisture generated from air induced from the outside into water. The purge tank 320 stores the water and liquid carrier condensed by the condenser 310. The carrier tank 400 receives from the purge tank 320 the water and liquid carrier liquid carrier, and a liquid carrier which is newly supplied from an external carrier source for replenishing the consumed developer liquid and stores the same, and sequentially stores the liquid carrier and water phase-separated from each other due to a difference in the specific gravity therebetween by driving a pump (P). The carrier/water separating means separates liquid carrier (C) and water (W) stored in the carrier tank 400 from each other and makes the same flow to different paths, respectively. The working solution tank 700 receives from the carrier tank 400 the liquid carrier C phase-separated from the water W by the water/carrier separating means, mixes the received liquid carrier C with concentrated ink supplied from an ink storage tank 430, to produce a developer liquid, and supplies the produced developer liquid to development devices of a developing unit 200. The waste water tank 600 receives from the carrier tank 400 the water W phase-separated from the liquid carrier C by the water/carrier separating means, and stores the same.

According to the present invention, the water/carrier separating means which is a feature of the present invention, is constructed such that the bottom surface of the carrier tank 400 has a sloping plane 410 which slopes downward at one side, and a horizontal plane 420 leading to an end of the sloping plane 410, and includes a water sensor 500 installed at a predetermined level position on the side wall of the carrier tank, the level position being higher than the horizontal plane 420, for detecting the water stored in the carrier tank 400, an exhaust pipe 510 which connects the carrier tank 400 and the waste water tank 600, so that an inlet 511 is disposed on the horizontal plane 420, and a valve 512 installed in the exhaust pipe 510 and selectively opened/closed depending on the presence of water detected by the water sensor 500, to make the water flow to the waste water tank 600.

According to the present invention, the water sensor 500 is preferably a conductivity sensor for detecting the presence of a predetermined liquid by measuring the conductivity of the liquid. The conductivity sensor measures the conductivities of water and carrier to thus detect the presence of water, utilizing the fact that the conductivity of water is higher than that of liquid carrier.

On top of the carrier tank 400 is installed an induction pipe 330 through which carrier and water are induced from the purge tank 320. The induction pipe 330 is preferably disposed to face the exhaust pipe 510.

Figure 1:
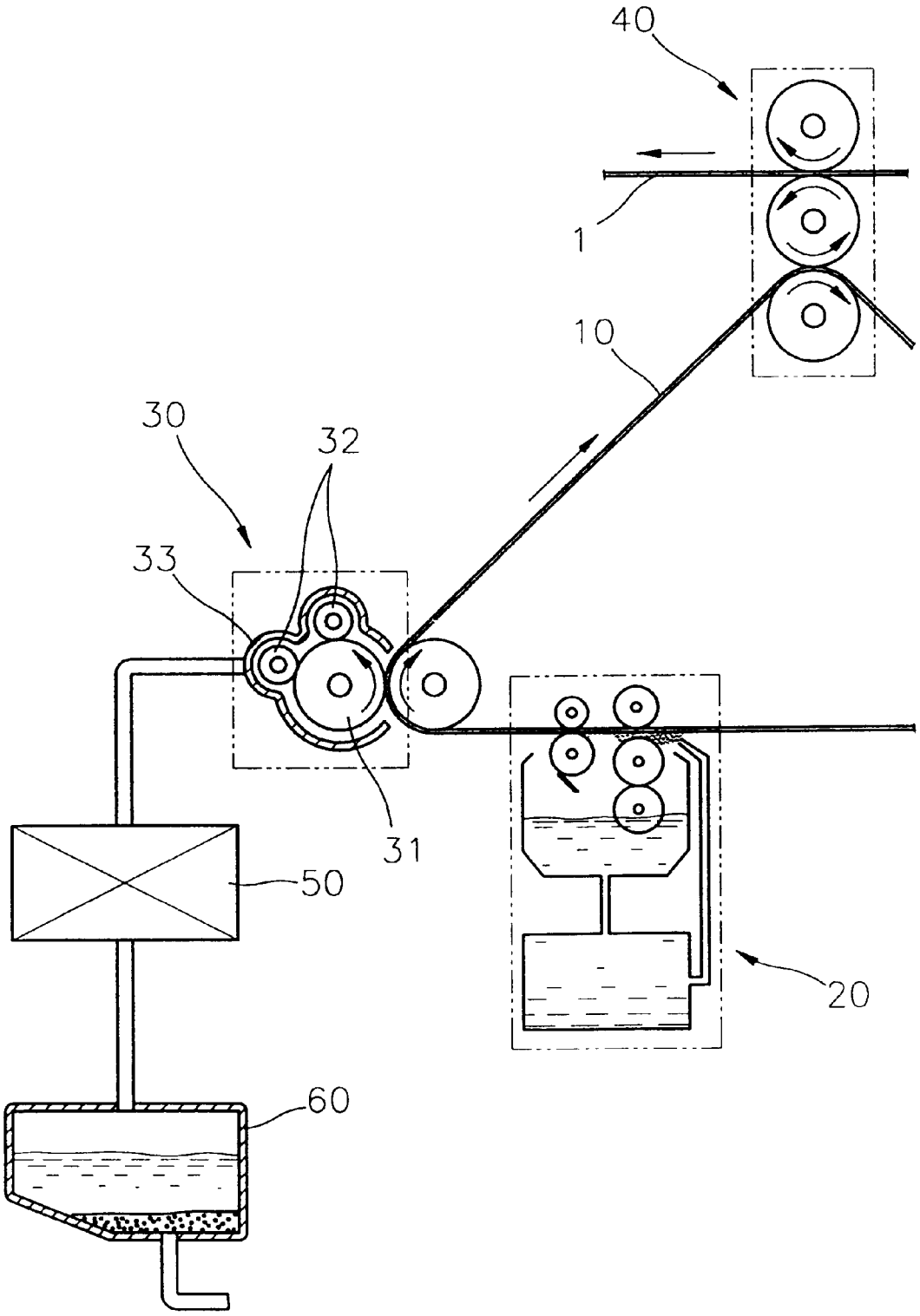
FIG. 1 (PRIOR ART)
FIG. 1 is a schematic diagram of a carrier recovery apparatus for a conventional liquid electrophotographic printer.

The drying unit 300 has substantially the same configuration as the drying unit 30 of the conventional liquid electrophotographic printer shown in FIG. 1, and the elements corresponding to those in the preceding drawings are designated by the same reference numerals.

In the above-described carrier recovery apparatus according to this embodiment, the liquid carrier C and water W evaporated and condensed by the drying unit 300 are recovered in the purge tank 320 and temporarily stored therein, and are then made to flow to the carrier tank 400 by the driving of the pump P. Here, the liquid carrier C which is oleaginous, and the water W are phase-separated from each other due to a difference in the specific gravity therebetween, so that the water W is first collected over the horizontal plane 420 and then the liquid carrier C fills thereon. In practice, much more liquid carrier than the water is recovered and stored in the carrier tank 400 and a new liquid carrier is additionally supplied to the carrier tank 400 through a supply pipe 440 connected to the outside to replenish the consumed developer liquid. Thus, the liquid carrier is collected even over the sloping plane 410 of the carrier tank 400.

When the amount of water W and liquid carrier C sequentially stored in the carrier tank 400 in a phase-separated state, gradually increases until the level of water W reaches the level at which the water sensor 500 as a conductivity sensor is installed, the water sensor 500 detects the presence of water W by measuring the conductivity thereof, and transmits a control signal to a controller (not shown). The controller controls the valve 512 installed in the exhaust pipe 510 to be opened in accordance with the control signal, so that the water W filling the horizontal plane 420 of the carrier tank 400 first flows into the waste water tank 600.

In the waste water tank 600, not only water having flowed out of the carrier tank 400 but also contaminated carrier used in development, although its detailed processing paths are not shown, are recovered and stored to then be disposed of.

Although the amount of water condensed varies depending on the atmospheric conditions of the operating environment, the amount of water W stored in the carrier tank 400 is maintained of a level equal to or lower than the position of the water sensor 500. In other words, the maximum amount of water W stored from the bottom of the carrier tank 400, specifically from the horizontal plane 420, to the level at which the water sensor 500 is installed, is kept constant. The time required to make a constant amount of the water W stored in the carrier tank 400 flow out of the carrier tank 400 is determined in advance and then data corresponding to the determined time is input to the controller. When the determined time has elapsed, the controller controls the valve 512 installed in the exhaust pipe 510 to be closed, thereby completing flow of only the water W while preventing the liquid carrier C from being exhausted.

While the water W flows to the waste water tank 600 through the exhaust pipe 510 by the operation of the water sensor 500, the liquid carrier C flows to the working solution tank 700 through a connection pipe 710 installed to be connected to the sloping plane 410 of the carrier tank 400. This is done by controlling a valve 720 installed in the connection pipe 710 for connecting the carrier tank 400 and the working solution tank 700 to be opened simultaneously when the valve 512 installed in the exhaust pipe 510 is opened.

The amount of the stored liquid carrier C is much larger than that of the stored water W, with storage being done in a substantially constant ratio of water W to liquid carrier C.

Therefore, when the level of water W reaches the position of the water sensor 500, based on the amount of liquid carrier collected on the water W, the time required to make the liquid carrier flow is determined in advance and then data corresponding to the determined time is input to the controller. When the determined time has elapsed, the controller controls the valve 720 installed in the connection pipe 710 for connecting the carrier tank 400 and the working solution tank 700 to be closed, thereby completing exhaust of the liquid carrier C stored in the carrier tank 400.

This embodiment is applied to a color printer, in which the liquid carrier C stored in the carrier tank 400 is supplied to a plurality of working solution tanks 700 labeled by Y, M, Cy and K, respectively, corresponding to various colors, for example, yellow, magenta, cyan and black, through each connection pipe 710. The working solution tanks 700 are connected to ink storage tanks 430 through connection pipes 701, respectively. A concentrated ink supplied from an external ink supply unit (not shown) such as a cartridge is stored in the ink storage tank 430. The concentrated ink in which toner particles and liquid carrier are mixed in a concentration of 15 weight percent of solids is supplied to the working solution tanks 700 through the connection pipes 701 by a constant amount to then be mixed with the carrier having flowed from the carrier tank 400, so that a developer liquid to be practically used in printing, having a concentration of 2 to 4 weight percent of solids, weaker than that of the concentrated ink, is produced. The thus-produced developer liquid is supplied to the photoreceptor belt 100 by driving the development devices of the developing unit 200. In such a manner, one cycle of recovery of liquid carrier is carried out.

Figure 4:
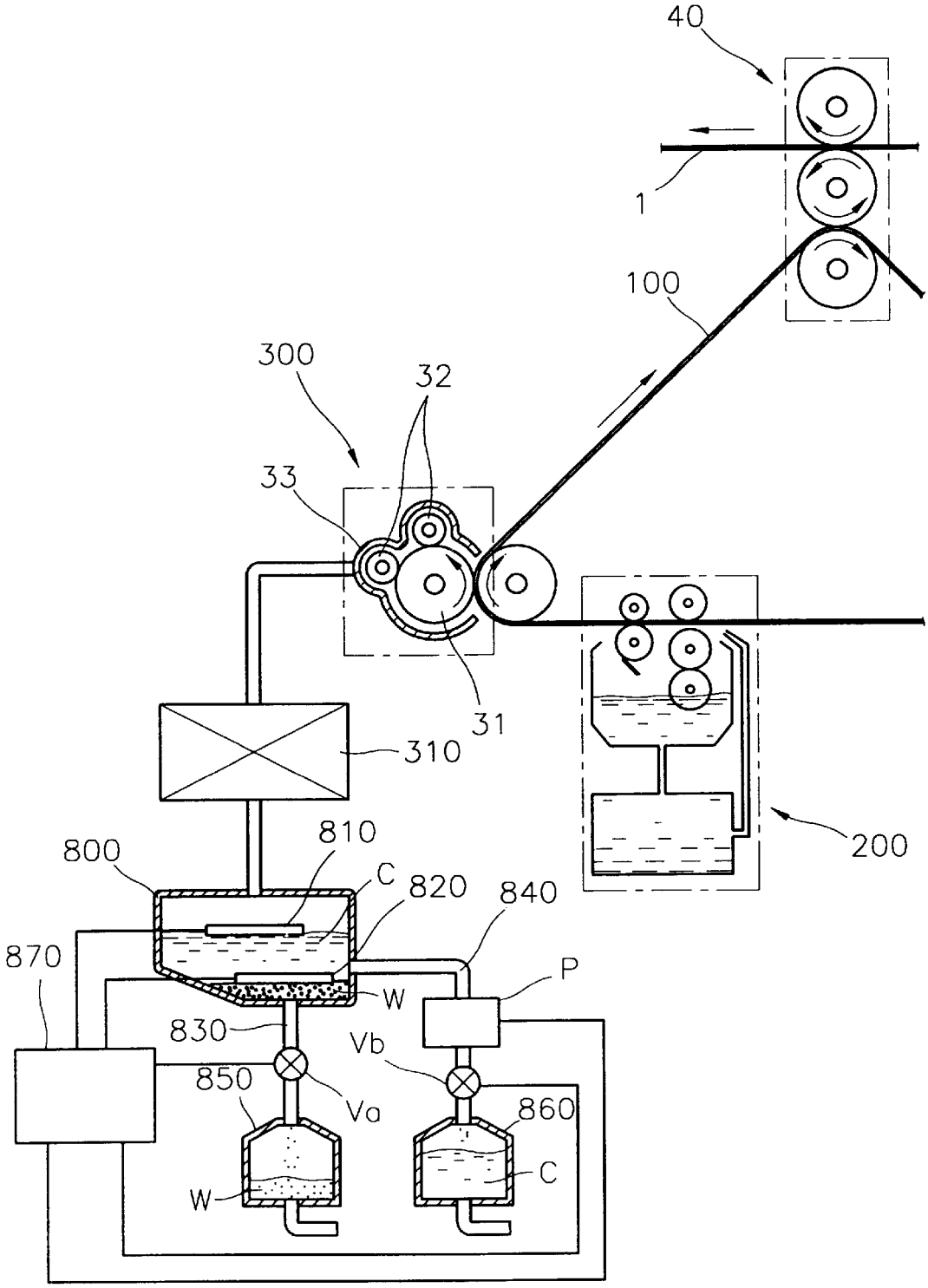
FIG. 4 is a schematic perspective view illustrating an essential portion of a carrier recovery apparatus according to another embodiment of the present invention.

FIG. 4 is a schematic perspective view illustrating an essential portion of a carrier recovery apparatus according to another embodiment of the present invention.

Referring to FIG. 4, the carrier recovery apparatus according to this embodiment includes a drying unit 300, a condenser 310, a purge tank 800, and a water/carrier separating means. The drying unit 300 absorbs liquid carrier from a photoreceptor belt 100 and evaporates the same. The condenser 310 collects the carrier evaporated by the drying unit 300, condenses the same into liquid carrier and simultaneously condenses moisture from air induced from the outside into water. The purge tank 800 sequentially stores the water and liquid carrier condensed by the condenser 310 in a phase-separated state. The carrier/water separating means separates the water and liquid carrier stored in the purge tank 800 from each other and makes the same flow to a waste water tank 850 and a carrier tank 860, respectively.

In the carrier recovery apparatus according to the present invention, the water/carrier separating means includes a water sensor 820, a first connection pipe 830, a first valve Va, a second connection pipe 840, a pump P, a second valve Vb and a controller 870.

The water sensor 820 is installed at a predetermined level on the purge tank 800, and detects the water W stored in the purge tank 800. The first connection pipe 830 connected to the bottom of the purge tank to form a path in a directly downward direction of the purge tank 800. The first valve Va is installed in the first connection pipe 830 to be selectively opened/closed depending on the presence of water W detected by the water sensor 820 and makes the water W flow to the waste water tank 850. The second connection pipe 840 forms a path in one side of the purge tank 800 to be disposed directly above the water sensor 820. The pump P is selectively driven in accordance with presence of water W detected by the water sensor 820 and draws out the liquid carrier C to the second connection pipe 840. The second valve Vb is installed in the second connection pipe 840 to be selectively opened/closed in accordance with the driving of the pump P and makes the liquid carrier C flow to the carrier tank 860. The controller 870 sequentially drives and controls the pump P, the first valve Va and the second valve Vb in accordance with presence of water W detected by the water sensor 820. Here, the elements corresponding to those in the preceding drawings are designated by the same reference numerals. Reference numeral 810 denotes a level sensor for measuring the level of the liquid carrier C collected on the water W stored from the bottom of the purge tank 800.

The water sensor 820 is preferably a conductivity sensor for detecting the presence of a predetermined liquid by measuring the conductivity of the liquid. The conductivity sensor differentiates between water and carrier, utilizing the fact that the conductivities of liquid carrier C and water W are different from each other.

In the carrier recovery apparatus according to the present invention, the liquid carrier C condensed and liquefied by the condenser 310 and the water W are collected in the purge tank 800. Here, the water W and the oleaginous liquid carrier C are phase-separated due to a difference in the specific gravity therebetween so that the water W is first collected on the bottom of the purge tank 800 and then the liquid carrier C fills thereon.

When the amount of water W and liquid carrier C sequentially stored in the purge tank 800 in such a phase-separated state, gradually increases until the level of water W reaches the level at which the water sensor 820 as a conductivity sensor is installed, the water sensor 820 detects the presence of water W by measuring the conductivity thereof, and transmits a control signal to the controller 870. The controller 870 controls the first valve Va to be opened in accordance with the control signal, so that the water W filling the lower portion of the purge tank 800 first flows to the waste water tank 850.

In the waste water tank 850, not only the water drawn out from the purge tank 800 but also the contaminated carrier used in development, although not shown in the drawing, are recovered and stored to then be disposed of.

Although the amount of water condensed varies depending on the atmospheric conditions of the operating environment, the amount of water W collected in the purge tank 800 from the bottom thereof is kept at a level that is equal to or lower than the position of the water sensor 820. The time required to make a constant amount of the water W stored in the purge tank 800 flow out of the purge tank 800 is determined in advance and then the determined time is stored in the controller 870. When the determined time stored in the controller has elapsed, the controller 870 controls the first valve Va to be closed, thereby completing transmission of only the water W while avoiding the liquid carrier C from being exhausted.

Since the level of water W collected in the purge tank 800 is always equal to or lower than the position of the water sensor 820 and an inlet of the second connection pipe 840 is positioned above the water sensor 820, exhaust of the water W through the second connection pipe 840 is fundamentally avoided.

Generally, the amount of stored liquid carrier C is much larger than that of the stored water W. in a substantially constant ratio of water W to liquid carrier C.

Therefore, when the level of water W reaches the position of the water sensor 820, the level of water W is detected by installing the level sensor 810 at a position of the purge tank 800, corresponding to the level of the liquid carrier C collected on the water W, thereby exhausting the water W. Simultaneously, the level sensor 810 detects the level of the liquid carrier C and transmits a control signal to the controller 870.

Accordingly, the controller 870 sequentially controls the driving of the pump P and the opening of the second valve Vb so that the liquid carrier C is exhausted to the carrier tank 860 through the second connection pipe 840. The liquid carrier C recovered in the carrier tank 860 is phase-separated from the water W to then be reused as a solvent for preparing a new developer liquid.

According to another aspect of the present invention, since water W and liquid carrier C are stored in a substantially constant ratio, when the level of water W reaches the position of the water sensor 820, the time required to make the liquid carrier C stored in the purge tank 800 flow out of the purge tank 800 is determined in advance, based on the amount of liquid carrier C collected on the water W, and then the determined time is stored in the controller 870. When the determined time stored in the controller has elapsed, the controller 870 may control the second valve Vb to be closed and simultaneously to stop driving the pump P. In this case, since the exhaust of liquid carrier C is not necessarily dependent on the level sensor 810, it is not necessary to install the level sensor 810.

Since the level of water W collected in the purge tank 800 is always equal to or lower than the position of the water sensor 820 and the inlet of the second connection pipe 840 is positioned above the water sensor 820, even if the pump P and the second valve Vb are omitted from the second connection pipe 840, a constant amount of the liquid carrier C can be collected in the purge tank 800 and simultaneously exhausted to the carrier tank 860 through the second connection pipe 840.

Figure 5:
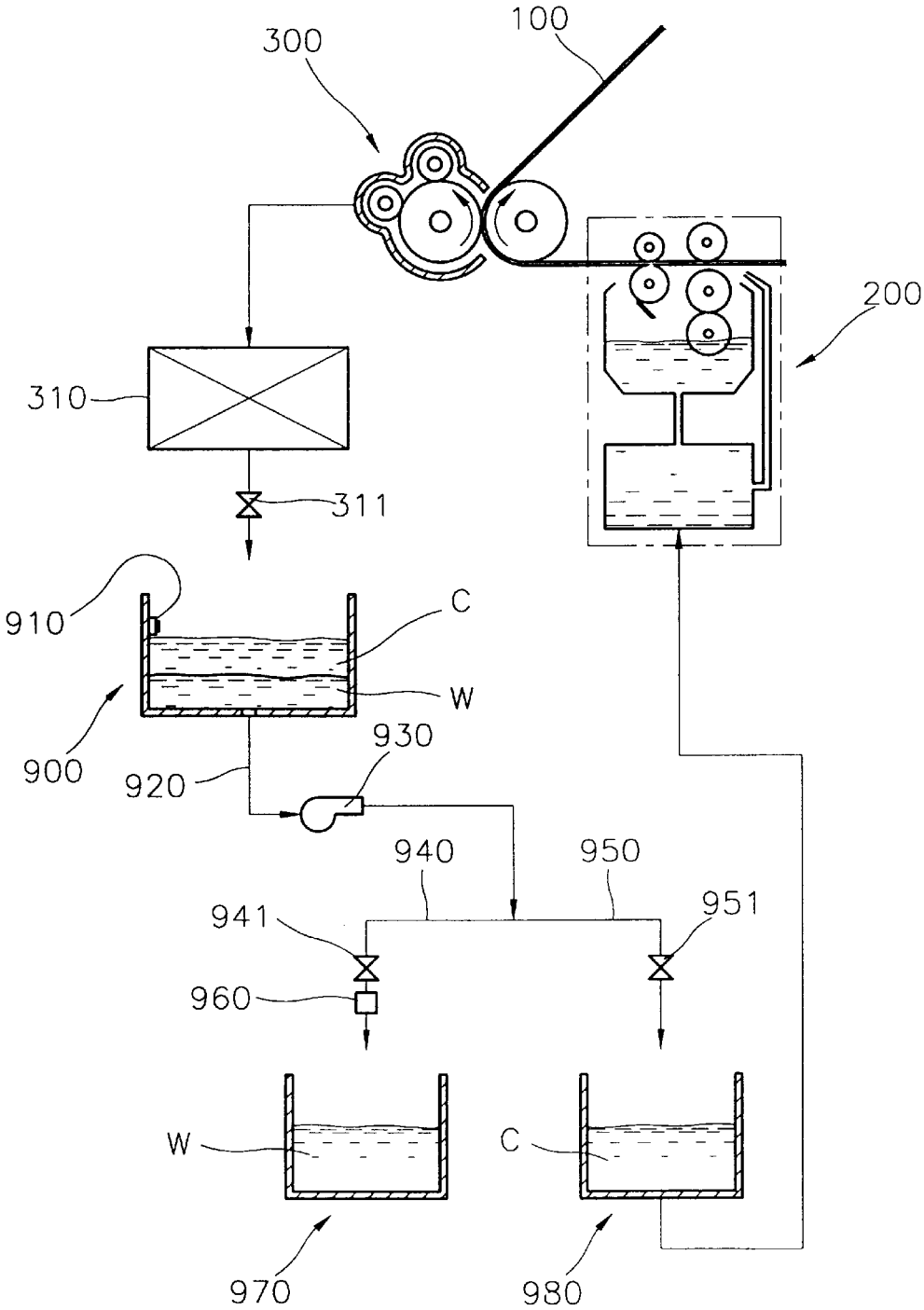
FIG. 5 is a schematic perspective view illustrating an essential portion of a carrier recovery apparatus according to still another embodiment of the present invention.

FIG. 5 is a schematic perspective view illustrating an essential portion of a carrier recovery apparatus according to still another embodiment of the present invention.

The carrier recovery apparatus according to this embodiment includes a drying unit 300 for absorbing liquid carrier from a photoreceptor belt 100 and evaporating the same, a condenser 310 for collecting the carrier evaporated by the drying unit 300, condensing the same into liquid carrier, and condensing the moisture generated from air unavoidably induced from the outside into water, a purge tank 900 in which the water and liquid carrier condensed by the condenser 310 are sequentially stored, and a water/carrier separating means for separating the water W and liquid carrier C stored in the purge tank 900 from each other and making the same flow to a waste water tank 970 and a carrier tank 980, respectively.

In the carrier recovery apparatus according to the present invention, the water/carrier separating means includes a level sensor 910, a pump 930, a first branching pipe 940, a second branching pipe 950 and a conductivity sensor 960.

The level sensor 910 is installed at a predetermined height on the purge tank 900, and detects the level of the liquid carrier C stored in the purge tank 900 to then generate as a signal representing the level of the liquid carrier C. According to the signal generated from the level sensor 910, the pump 930 is driven to draw out the water W and liquid carrier C stored in the purge tank 900 through a connection pipe 920 connected to the bottom of the purge tank 900. The first branching pipe 940 is branched off from the connection pipe 920 to be connected to the waste water tank 970, and includes a first valve 941 selectively opened or closed. The second branching pipe 950 is branched off from the connection pipe 920 to be connected to the carrier tank 980, and includes a second valve 951 selectively opened or closed. The conductivity sensor 960 installed at one end of the first branching pipe 940, detects the conductivities of water W and liquid carrier C and transmits a control signal for selectively opening or closing the first valve 941 and the second valve 951. Here, the elements corresponding to those in the preceding drawings are designated by the same reference numerals. Reference numeral 311 denotes an opening/closing valve installed in a connection pipe for connecting the condenser 310 and the purge tank 900.

Carrier movement from the condenser 310 to the purge tank 900 is selectively prohibited by the opening/closing valve 311.

Figure 6:
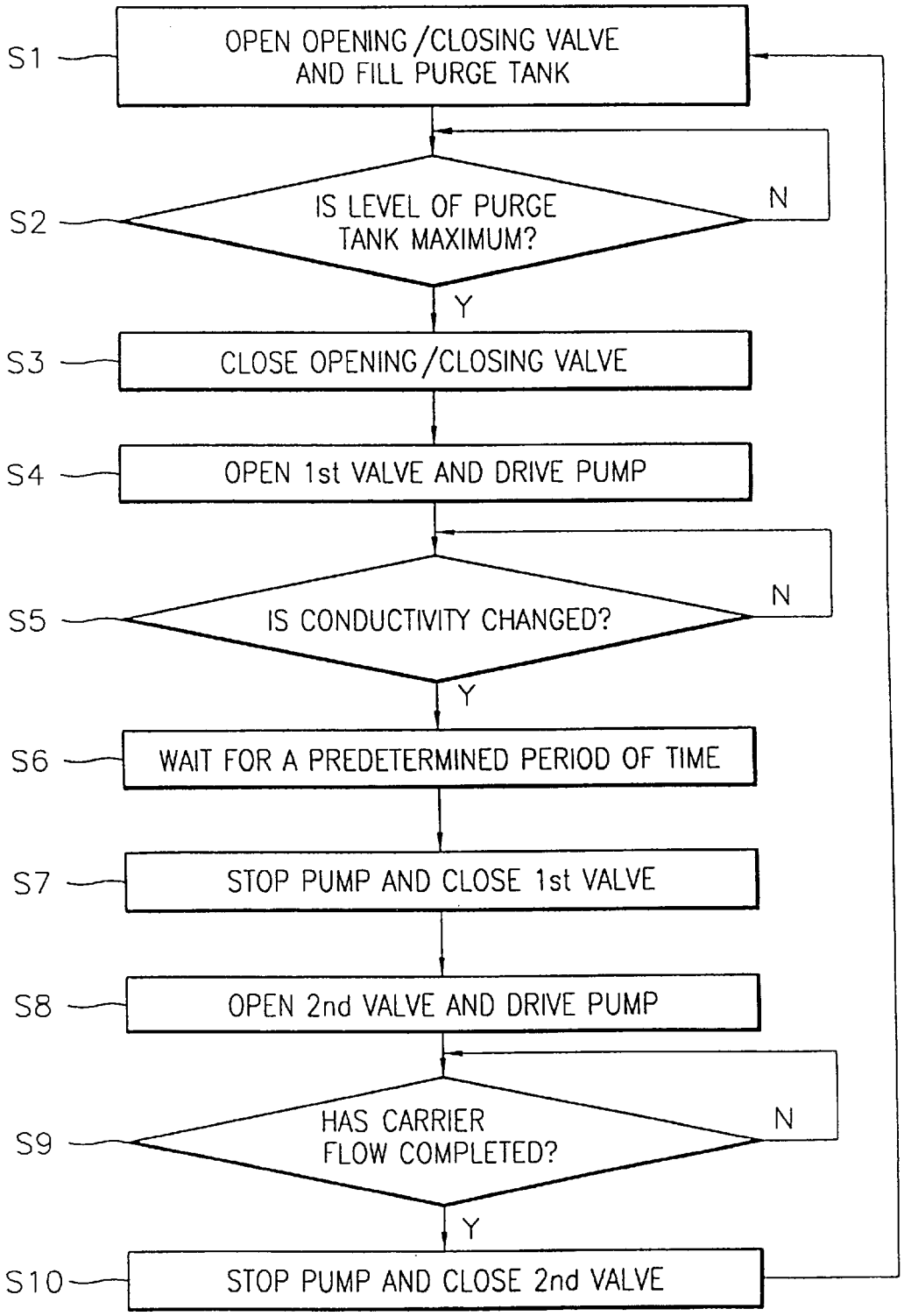
FIG. 6 is a flow chart illustrating the operating steps of the carrier recovery apparatus shown in FIG. 5.

Now, the operation of the carrier recovery apparatus having the above-described configuration will be described with reference to FIG. 6.

First, the carrier evaporated by the drying unit 300 during printing and the moisture from air unavoidably induced are condensed into liquid carrier and water by the condenser 310, respectively, and then continuously accumulated in the purge tank 900 (step Si). Here, the opening/closing valve 311 is opened.

When the level of the liquid inclusive of the water and the liquid carrier filled in the purge tank 900 rises to a predetermined maximum level, the level of the liquid is detected by the level sensor 910 (step S2). Then, the opening/closing valve 311 is closed to prohibit liquid movement between the condenser 310 and the purge tank 900 (step S3).

The carrier C and the water W in the purge tank 900 are phase-separated due to a difference in the specific gravity therebetween and are stored such that the water W is disposed in the lower portion of the purge tank 900 and the carrier C is disposed thereon.

Therefore, if the liquid (the water and liquid carrier) stored in the purge tank 900 is made to flow out of the purge tank 900 by driving the pump 930 installed in the connection pipe 920 connected to the bottom of the purge tank 900, only the water W flow out of the purge tank 900 initially.

Next, in a state in which the first valve 941 is opened and the second valve 951 is closed, the pump 930 is driven to make the liquid stored in the purge tank 900 flow out of the purge tank 900 through the connection pipe 920 (step S4). Here, the water W first flows out of the purge tank 900 and the conductivity sensor 960 measures the conductivity of the liquid induced into the waste water tank 970 (step S5).

Thereafter, as soon as the water W stored in the purge tank 900 completely flows out of the purge tank 900, the liquid carrier C starts to flow. Here, utilizing the fact that the conductivities of the water W and the liquid carrier C are different from each other, that is, the conductivity of the water W is higher than that of the liquid carrier C, the conductivity sensor 960 detects an abrupt drop in the conductivity of the liquid measured, thereby determining whether the water W has completely flowed from the purge tank 900. Then, in order to prevent moisture from remaining in the purge tank 900, there is a standby time of 2 to 3 seconds (step S6). In this case, a small amount of liquid carrier flows out of the purge tank 900.

Next, the driving of the pump 930 is stopped and the first valve 941 is closed (step S7). Subsequently, the second valve 951 is opened and the pump 930 is driven again (S8). Then, the liquid carrier C stored in the purge tank 900 starts to flow out of the purge tank 900.

The carrier C having flowed in such a manner is recovered and stored in the carrier tank 980. Then, if the carrier C stored in the purge tank 900 completely flows out of the purge tank 900 (step S9), the driving of the pump 930 is stopped and the second valve 951 is closed (step S10). Here, carrier completion may be determined by separately installing a minimum level detecting sensor in the purge tank 900. Otherwise, carrier completion can be estimated by counting the capacity and operating time of the pump 930.

The carrier C recovered in the carrier tank 980 through the above-described procedure is again mixed with a concentrated ink supplied from an ink supply unit (not shown) such as an ink cartridge in a working solution tank (not shown) to be reused as a developer liquid used in printing.

As described above, in the carrier recovery apparatus of a liquid electrophotographic printer according to various embodiments of the present invention, the purity of liquid carrier recovered via a drying unit and a condenser can be enhanced by effectively and accurately removing moisture (water) from the recovered liquid carrier, thereby maintaining a precise concentration of a developer liquid to improve printing quality.

What is claimed is:

1. A carrier recovery apparatus, for a liquid electrophotographic printer; comprising:

a drying unit for absorbing liquid carrier from a developer liquid supplied to and remaining on a photoreceptor belt and evaporating the absorbed liquid carrier;

a condenser for condensing the carrier gas evaporated by the drying unit and moisture from air induced from an outside into liquid carrier and water, respectively;

a purge tank for storing water and liquid carrier condensed by the condenser;

a carrier tank for storing the water and liquid carrier condensed by the condenser in a phase-separated state and storing a new liquid carrier additionally induced from the outside;

water/carrier separating means for separating liquid carrier and water stored in the carrier tank from each other and making the same flow through different paths, respectively;

a waste water tank for receiving from the carrier tank the water phase-separated from the liquid carrier by the water/carrier separating means, and storing the same; and a working solution tank for receiving from the carrier tank the liquid carrier phase-separated from the water by the water/carrier separating means, and mixing the received liquid carrier with concentrated ink supplied from an external ink storage tank, to produce the developer liquid.

2. The carrier recovery apparatus according to claim 1, wherein the carrier tank has a side wall and a bottom surface that slopes downward at one side, and the water/carrier separating means includes a water sensor installed on the side wall of the carrier tank, an exhaust pipe which connects the carrier tank and the waste water tank to form a flow path, and a valve installed in the exhaust pipe to be selectively opened/closed depending on the presence of water detected by the water sensor.

3. The carrier recovery apparatus according to claim 2, wherein the bottom surface has a sloping plane that downwardly slopes to one side, and a horizontal plane leading to an end of the sloping plane, the water sensor is installed at a predetermined level on the side wall of the carrier tank, the predetermined level being higher than the horizontal plane, and the exhaust pipe is connected to the horizontal plane.

4. The carrier recovery apparatus according to claim 2, wherein the water sensor is a conductivity sensor for detecting the conductivity of a liquid and generating a signal representing the presence of the liquid.

5. The carrier recovery apparatus according to claim 2, further comprising:

an induction pipes through which the carrier condensed and recovered by the drying unit is induced, disposed to face the exhaust pipe.

6. A carrier recovery apparatus for a liquid electrophotographic printer comprising:

a drying unit for absorbing liquid carrier from a developer liquid supplied to and remaining on a photoreceptor belt and evaporating the absorbed liquid carrier;

a condenser for condensing the carrier evaporated by the drying unit into liquid carrier, and condensing moisture from air induced from an outside into water;

a purge tank for storing the water and liquid carrier condensed by the condenser in a phase-separated state;

water/carrier separating means for separating the liquid carrier and water stored in the purge tank from each other and making the same flow through different paths, respectively;

a waste water tank for receiving from the purge tank the water phase-separated from the liquid carrier by the water/carrier separating means, and storing the same; and a carrier tank for receiving the carrier phase-separated from the water by the water/carrier separating means and storing the same, and additionally receiving a new carrier from the outside and storing the same.

7. The carrier recovery apparatus according to claim 6, wherein the water/carrier separating means comprises:

a water sensor installed at a predetermined level on the purge tank, for detecting the presence of water according to the change in the level of water;

a first connection pipe connected to the bottom of the purge tank to form a path for connecting the purge tank and the waste water tank;

a first valve installed in the first connection pipe to be selectively opened/closed depending on the presence of water detected by the water sensor and making the water flow from the purge tank to the waste water tank;

a second connection pipe disposed directly above the water sensor to form a path for connecting the purge tank and the carrier tank, in one side of the purge tank.

8. The carrier recovery apparatus according to claim 7, wherein the water sensor is a conductivity sensor for detecting the conductivity of a liquid and generating a signal representing the presence of the liquid.

9. The carrier recovery apparatus according to claim 7, wherein a level sensor is installed at a level position of the purge tank corresponding to a level of the liquid carrier collected on the water when the water level reaches the level position at which the water sensor is installed.

10. The carrier recovery apparatus according to claim 7, wherein the second connection pipe comprises:

a pump selectively driven in accordance with presence of water detected by the water sensor, for drawing out the liquid carrier; and a second valve installed to be selectively opened/closed in accordance with the driving of the pump, for making the liquid carrier flow to the carrier tank.

11. The carrier recovery apparatus according to claim 6, wherein the water/carrier separating means comprises:

a level sensor installed at a predetermined level on the purge tank, for detecting the level of the liquid carrier in the purge tank and generating a signal representing the level of the liquid carrier;

a pump driven to draw out the water and liquid carrier stored in the purge tank through a connection pipe connected to the bottom of the purge tank in accordance with the signal generated from the level sensor;

a first branching pipe branched off from the connection pipe to be connected to the waste water tank, and having a first valve selectively opened or closed;

a second branching pipe branched off from the connection pipe to be connected to the carrier tank, and having a second valve selectively opened or closed; and a conductivity sensor installed at one end of the first branching pipe, for detecting the conductivities of the water and the liquid carrier and transmitting a control signal for selectively opening or closing the first valve and the second valve.

* * * * *